US005733224A

United States Patent [19]

Reid

[11] Patent Number: 5,733,224

[45] Date of Patent: Mar. 31, 1998

[54] APPARATUS AND METHOD FOR CUSHIONING ATHLETIC EQUIPMENT

[76] Inventor: Norman Reid, 11501 Sara Loop Rd., Yakima, Wash. 98908

[21] Appl. No.: 707,859

[22] Filed: Sep. 9, 1996

Related U.S. Application Data

[63] Continuation of Ser. No. 368,609, Jan. 4, 1995, abandoned.

[51] Int. Cl.[6] ..... A63B 17/00

[52] U.S. Cl. ..... 482/23

[58] Field of Search ..... 482/15, 81, 23, 482/83, 25, 29, 14, 139; 5/652, 653, 654, 658, 663; 472/92–94, 136, 137

[56] References Cited

U.S. PATENT DOCUMENTS

| | | | |
|---|---|---|---|
| 2,187,676 | 1/1940 | Blewen | 4/252 |
| 2,429,939 | 10/1947 | Masterson et al. | 272/58 |
| 2,944,815 | 7/1960 | Moyer | 272/60 |
| 3,046,573 | 7/1962 | Davis et al. | 5/652 |
| 3,242,509 | 3/1966 | Nissen | 5/344 |
| 3,636,576 | 1/1972 | Nissen | 5/344 |
| 4,057,245 | 11/1977 | Gordon | 482/15 |
| 4,557,475 | 12/1985 | Donovan | 272/3 |
| 5,037,086 | 8/1991 | Strand | 272/111 |
| 5,133,699 | 7/1992 | Cooper | 482/34 |
| 5,261,134 | 11/1993 | Matthews | 5/652 |

FOREIGN PATENT DOCUMENTS

| | | | |
|---|---|---|---|
| 2605521 | 4/1988 | France | 482/23 |
| 2170416A | of 0000 | United Kingdom . | |

OTHER PUBLICATIONS

Martial Arts Supplies Co., from Black Belt, Jan. 1979 p. 15.

Nissen Gymnasium Equipment 1975 Catalog –Selected Pages

*Primary Examiner*—Stephen R. Crow

*Attorney, Agent, or Firm*—Stratton Ballew PLLC

[57] ABSTRACT

A gymnastic mat having a substantially vertical slot along one edge thereof and at least one engaging edge defined in the slot for removably mounting the gymnastic mat about the non-horizontal support members of various types of athletic and gymnastic equipment; and a method for using such a mat. The mat may have a substantially rigid upper surface to permit the gymnast to regain her footing or balance thereon. Additional gymnastic mats are attachable to the first gymnastic mat to modify the shape and size of the protected area.

16 Claims, 8 Drawing Sheets

APPARATUS AND METHOD FOR CUSHIONING ATHLETIC EQUIPMENT

This application is a continuation of U.S. application Ser. No. 08/368,609, filed Jan. 4, 1995, now abandoned.

BACKGROUND OF THE INVENTION

1. Field of the Invention

The present invention relates to the field of providing shock absorbing or cushioning mats for athletic equipment. More particularly, the invention pertains to mats for cushioning non-horizontal structural elements of gymnastic equipment, such as a balance beam and the like.

2. Description of the Prior Art

Until now, the design of gymnastic mats has been directed toward protecting gymnasts and other athletes from injuries due to impact with the floor or ground.

For example, U.S. Pat. No. 3,636,576 to Nissan for a Roll-Fold Floor Mat for Gymnastic and Athletic Purposes discloses a plurality of abutting rectangular mat sections having varying dimensions which permit the mats to be "roll-folded" together. These mats are designed to cover a gymnasium floor, and no suggestion is made that the mats be used to provide protection to gymnasts from impact with gymnastic equipment.

U.S. Pat. No. 3,242,509 also to Nissan for a Gymnastic Floor Covering discloses rectangular mats having interconnecting edges for forming a large continuous cushioned floor surface. A recess is formed in the bottom surface along an edge of the mat. The opposing edge has a tongue formed on the bottom surface for being received in the recess of an adjacent mat. The tongue portion has hook fastener material sewn thereon, the recess having loop fastener material sewn thereon whereby adjacent edges may be secured together. While there is a suggestion that the mat may be used to cover exposed parts of gymnastic apparatus, there are no structural provisions for covering non-horizontal parts of gymnastic apparatus.

U.S. Pat. No. 2,944,815 to Moyer for a Method of Mounting of Gymnastic Equipment discloses the use of strips or sections of mats which may be rearranged on a base about gymnastic equipment standards, as the standards are moved closer or farther apart. FIG. 1 of the No. '815 patent discloses a cut-away section of the mat. This cut-away section provides clearance for the gymnastic equipment standards. The cut-away section is spaced from the standards, and shows cushioning on only two sides of the standards. The mat extends vertically upward only a small percentage of the height of the standard, providing virtually no protection against collision with the standard. It is clear that this mat is not designed to protect a user from injuries due to contact with the standards; rather, it is designed to protect the user from injuries due to impact with the floor.

U.S. Pat. No. 2,429,939 to Masterson et al. for a Convertible and Demountable Gymnastic Chair discloses a rectangular mat which in one aspect covers the horizontal cross member of the structure. The mat lies between the opposed, substantially vertical support members, providing no protection for the user from contact with the same. As in the other references, the concern of the inventors is protection from injury due to contact with the ground as opposed to contact with the vertical support members of the gymnastic equipment.

U.S. Pat. No. 2,187,676 to Biewen for an Absorbent Floor Mat discloses a floor covering having a U-shaped vertical slot therein for providing protection to the floor surrounding a toilet. There is no suggestion that the floor covering be used to provide protection to the user from impacts with the toilet. Additionally, no means are shown for securing the floor mat to the commode.

Gymnastics, as well as other forms of athletics, are pursued at various skill levels by millions of people. Often, these persons are beginners or poorly trained and the possibility of injury due to contact with the equipment is high. Even at higher skill levels the risk of injury remains high due to the more complicated and intense use these athletes make of the equipment. Attempts have been made by gymnasts and their coaches and instructors to cushion the structural members of gymnastic equipment, since accidental collision with the support leg or base of a piece of equipment can cause serious injury to the gymnast. A conventional gymnastic mat, generally a rectangular piece of 1 inch thick closed-cell foam, covered by resin impregnated nylon cloth, is often leaned against the equipment in an effort to provide the needed cushioning.

The current method of laying a conventional gymnastic mat against a piece of gymnastic equipment presents several problems. First, a mat which is leaned against a piece of equipment will rarely remain in that position. It will tend to slide across the smooth floor of a gymnasium or other floor surface. Second, because a conventional mat is intended to be laid on a flat surface, its use as a cushion around the support leg and/or base of gymnastic equipment is unwieldy and can obstruct the gymnast's access to the equipment, creating additional safety hazards. Additionally, the mat will often fail to cover other portions of the gymnastic equipment which should not be left exposed. Third, the relatively thin rectangular mat commonly used does not provide enough cushion to offer protection from injury, especially when contacted at high speed. Finally, a conventional mat leaned against equipment is not sufficiently rigid to prevent it from flexing about the equipment. As the mat flexes, it will tend to move out of position, exposing portions of the equipment. Flexing also reduces the effectiveness of the mat by causing the force of an impact to be distributed over a relatively small portion of the shock absorbing area.

An additional need exists for specialized matting for use with a balance beam. A standard balance beam is just 4" wide, and is positioned about 4 feet off the ground. When a gymnast is learning and practicing mounts and dismounts on the balance beam, there is a strong probability that she will misstep, causing her to fall from the balance beam to the floor. When more difficult maneuvers, such as aerial cartwheels, front and back handsprings, and front and back aerial somersaults, are performed on the balance beam, the potential injury to the gymnast is even greater due to the momentum resulting from the maneuver. A coach or "spotter" must stay with the gymnast along the balance beam at all times, to assist the gymnast should she begin to fall. This prevents a gymnastic coach from working with more than one gymnast at a time. A need therefore exists for a protective mat which can be used in training and practicing balance beam maneuvers, to protect the gymnast from injury during the inevitable falls that occur. A mat for use with a balance beam should not only provide cushioned protection, but should additionally provide a sufficiently rigid surface, close to the top of the balance beam, to allow the gymnast to regain her footing or balance, thereby preventing injury.

There is a demonstrated need in the field of athletics and gynmastics for a mat which overcomes the aforementioned problems and provides athletes with protection from injuries resulting from collisions with and falls from the equipment they are using.

SUMMARY OF THE INVENTION

The present invention is a gymnastic mat having a substantially vertical slot defined therein, the vertical slot having at least one substantially vertical engaging edge for allowing the gymnastic mat to be mountably received about a substantially vertical support member of a piece of athletic or gymnastic equipment. While the mat may have any shape and dimensions, it is preferably relatively thick in comparison to standard gymnastic floor mats, to provide protection about the entire length of the structural support member. Additionally, the mat contains a rigid horizontal layer or plate for providing support therein for a gymnast to recover her footing from misteps, and missed mounts and dismounts. The slot with the engaging edge permits the mat to substantially surround the support member, and resist accidental dislodging from the support member.

Means for attaching additional mats is provided such that the size and shape of the protected area may be changed to correspond to the type of equipment and ability of the user. The slot or slots provided in the mats may be of any desired size and shape, provided at least one engaging edge exists on at least one of the mats for securing the mat structure to the support member or structure of the athletic equipment.

A first object of the invention is to provide a cushioned, protective covering for substantially non-horizontal structural members of athletic and gymnastic equipment.

A second object of the invention is to provide a cushioned, protective covering which may be readily mounted and dismounted.

A third object of the invention is to provide a cushioned, protective covering which resists accidental dislodging.

A fourth object of the invention is to provide a method for changing the dimensions of the cushioned, protective covering by allowing additional mats to be easily added to the first or base mat.

A fifth object of the invention is to provide a cushioned, protective covering which will break the fall of a gymnast on a balance beam.

A sixth object of the invention is to provide a method for learning gymnastic maneuvers on the balance beam with reduced risk of injury to the gymnast.

This invention can be broadly summarized as a mat having an outer covering, a shock absorbing material within the covering, and a substantially vertical slot therethrough, the slot having an engaging edge for permitting the mat to be received and retained about the vertical support member of a piece of athletic or gymnastic equipment.

This invention can also be summarized as a method of protecting users from injury due to impact with the non-horizontal support members of athletic and gymnastic equipment, by disposing a gymnastic mat having a slot with an engaging edge therein about the support member prior to use.

An additional mat may be likewise disposed about the athletic equipment and secured to the first or base mat.

DESCRIPTION OF THE PREFERRED EMBODIMENTS

Figure 1:
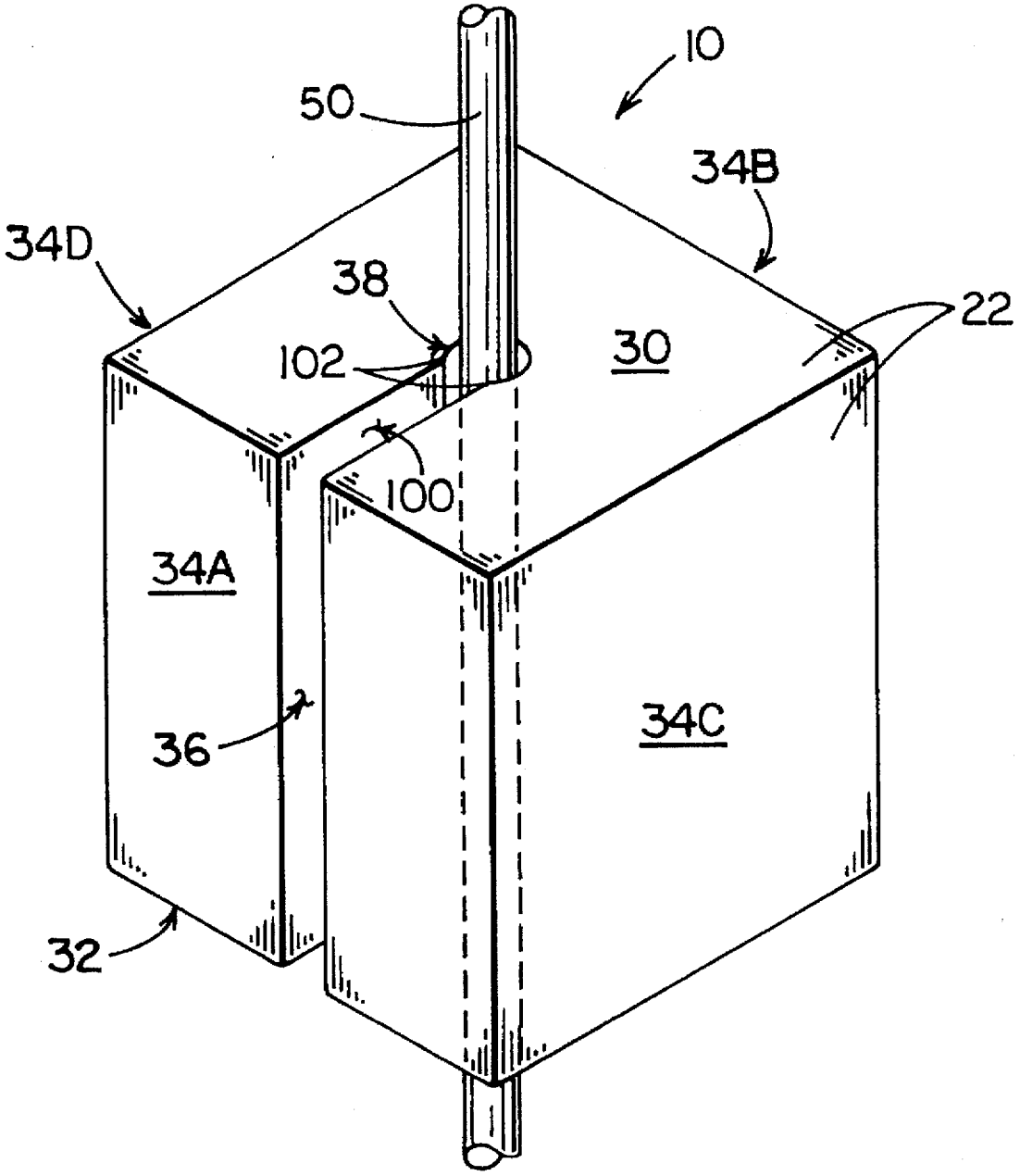
FIG. 1 is a perspective view of a preferred embodiment of the mat, having a slot with a circular terminus, as used with a tubular vertical support member.

With reference to FIG. 1 of the drawings, the mat 10 comprises an outer cover 22, having formed therein a substantially vertical slot 100, with at least one engaging edge 26 therein. Means for cushioning 20 is encased in protective outer cover 22 (see FIG. 8). The outer cover 22 may be comprised of at least one layer of a flexible, preferably puncture resistant material. Alternatively, the cover may be comprised of several layers of material (not shown), each layer contributing to the outer cover's overall strength and providing other distinct advantages such as puncture resistance, water proofing and durability. In the preferred embodiment, a single layer of vinyl coated nylon is preferred for the outer cover 22 due to its relatively high strength and low cost.

The outer cover 22 has a top surface or face 30, a bottom surface or face 32 and at least one wall 34 connecting the top and bottom surfaces. While the mat 10 may be of any shape, a cubic mat, as shown in the drawings, is preferred. The cubic mat is composed of a square top surface 30, a square bottom surface 32, a front wall **34*a*, a rear wall 34*b* and two side walls 34*c*, 34*d*, each of the side walls 34*c*, 34*d* forming right angles with its adjacent front and rear walls, 34*a*, 34*b*, respectively. The top surface 30 and the bottom surface 32 are joined at or proximate their peripheries respectively to the top and bottom edges of the walls 34**.

A slot 100 in the outer cover 22 extends vertically from top surface 30 to bottom surface 32, and perpendicularly inward from front wall **34*a*, ending in a slot terminus 38. In a preferred embodiment, slot 100 may be narrower at its opening 36 in front wall 34*a*, than at its terminus 38, thus forming an engaging edge 102 between the terminus 38 and the front wall 34*a***.

The slot 100 may be of any shape suitable for receiving the support member to be cushioned. FIG. 1 illustrates a preferred embodiment of the mat 10, having a circular slot terminus 38, in use with a piece of gymnastic equipment having a support member 50 which is substantially vertically oriented and substantially tubular in shape. A vault or spingboard is an example of such equipment. The slot 100 is of a uniform width from its opening 36 at the front wall **34*a*, extending inward toward the slot terminus 38. The slot terminus 38 is a circle of a diameter greater than the width of the slot 100 and which will accommodate the tubular support member 50. The flexibility of the cushioning material (See FIG. 8) allows the slot 100 to widen slightly as the support member 50 is pushed past the engaging edges 102, into position at the terminus 38 of slot 100**.

Figure 2:
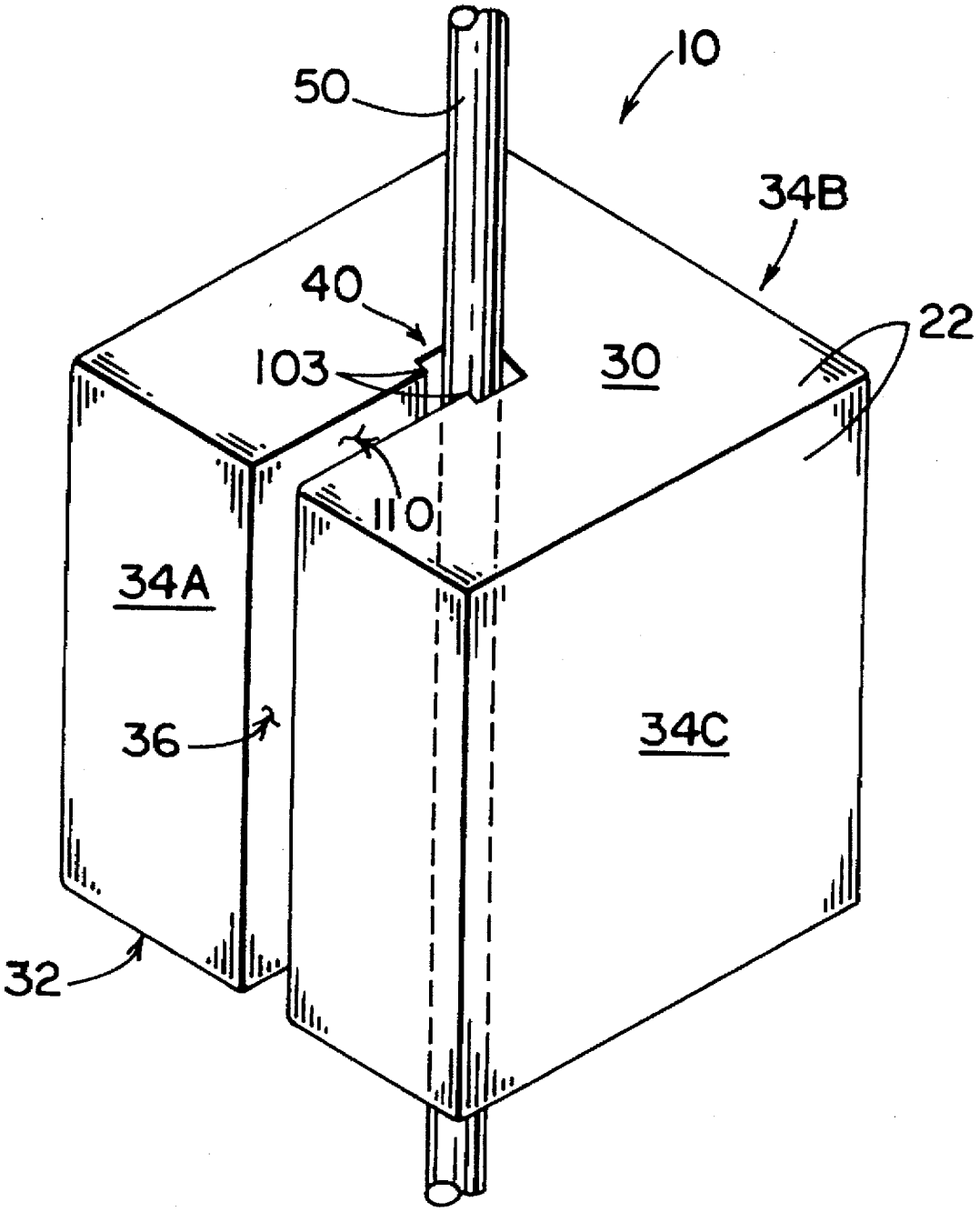
FIG. 2 is a perspective view of a preferred embodiment of the mat, having a T-shaped slot, as used with a tubular vertical support member.

FIG. 2 illustrates an alternative preferred embodiment of the mat 10, having a T-shaped slot 110, in use with a piece of gymnastic equipment having a support member 50 which is substantially vertically oriented and substantially tubular in shape. The distal end of the bottom portion of the "T" defines the opening 36 in the front wall 34*a*. The bottom portion of the "T" defining the slot 110 having a uniform width from the opening 36 at the front wall 34*a* to the engaging edges 103. The upper portion of the "T" defines the terminus 40 of the T-shaped slot 110. The terminus 40 is spaced from the front wall 34*a* by the lower portion of the T-shaped slot 110. The terminus 40 is substantially square or rectangular in shape and extends laterally on either side of the T-shaped slot 110. The width of the terminus 40 is greater than that of the lower portion of the T-shaped slot 110 and sufficient to accommodate the tubular support member 50. The T-shaped slot 110 provides a pair of substantially vertical engaging edges 103 spaced on either side of the lower portion of the T-shaped slot 110 from one another. The engaging edges 103 are defined by the respective right angles formed between the upper portion and the lower portion of the "T". The flexibility of the cushioning material (See FIG. 8) allows the slot 110 to widen slightly as the support member 50 is pushed through the opening 36, past the engaging edges 103, into position at the terminus 40 of slot 110.

Figure 3:
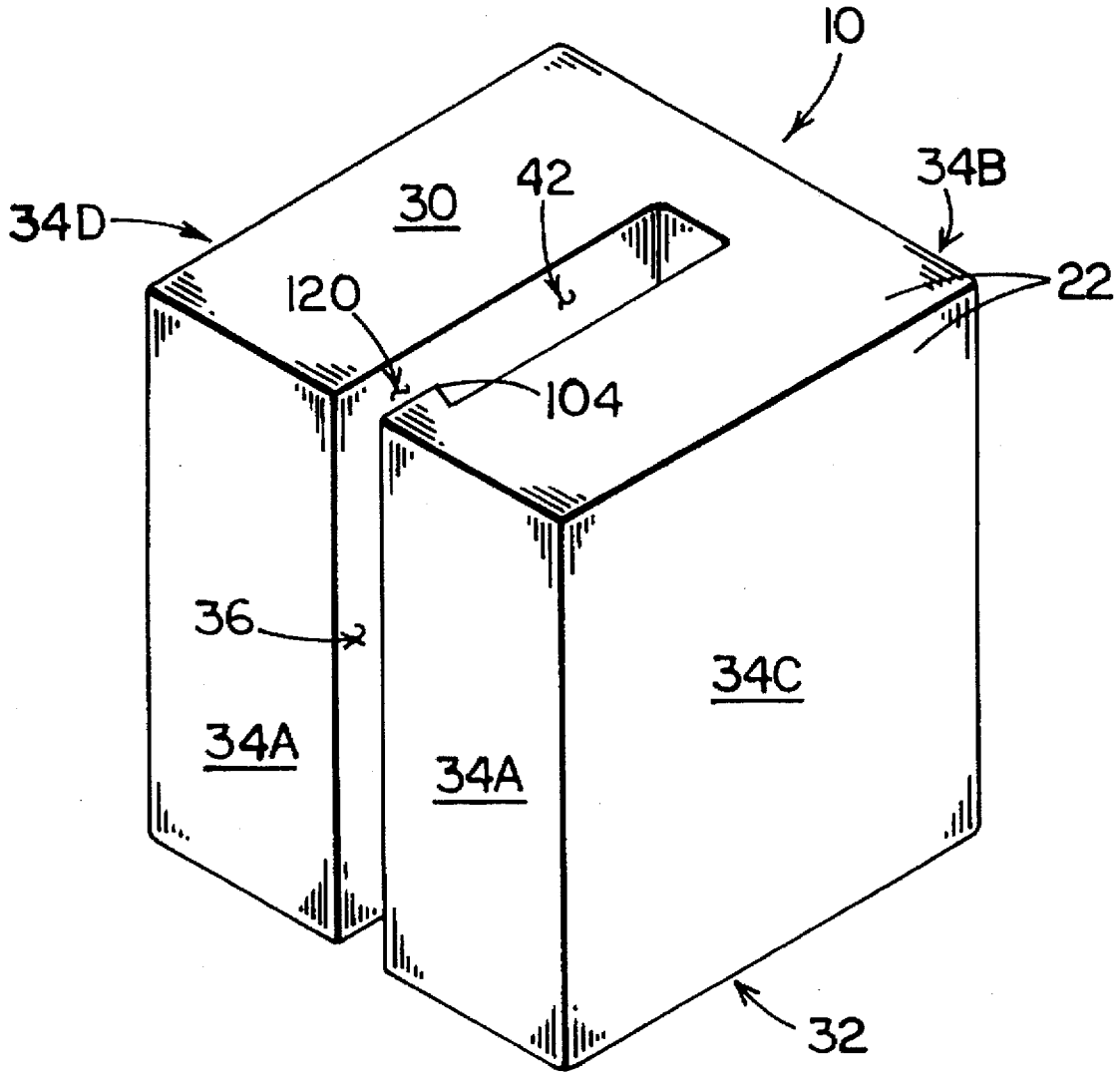
FIG. 3 is a perspective view of a preferred embodiment of the mat having an L-shaped slot.

FIG. 3 illustrates another alternative preferred embodiment of the mat 10, having an L-shaped slot 120. The distal end of the upper portion of the "L" defines the opening 36 in the front wall 34*a*. The upper portion of the "L" defining the slot 120 having of a uniform width from the opening 36 at the front wall 34*a* to the engaging edge 104. The lower portion of the "L" defines the terminus 42 of the L-shaped slot 120. The terminus 42 is spaced from the front wall 34*a* by the upper portion of the L-shaped slot 120. The terminus 42 is substantially square or rectangular in shape and extends laterally on one side of the upper portion of the L-shaped slot 120. The width of the terminus 42 is greater than that of the L-shaped slot 120 and sufficient to accommodate the tubular support member 50. The L-shaped slot 120 provides a substantially vertical engaging edge 104 on one side of the slot 120. The engaging edge 104 is defined by the respective right angle formed between the upper portion and the lower portion of the "L". The flexibility of the cushioning material (See FIG. 8) allows the upper portion of the L-shaped slot 120 to widen slightly as the support member 50 is pushed through the opening 36, past the engaging edge 104, into position at the terminus 42 of slot 120.

With reference to FIGS. 1, 2 and 3, the engaging portion of the outer cover 22, that is the portion between the front wall 34*a* and the engaging edges 102, 103, and 104, must be sufficiently rigid to resist accidental dislodging of the mat 10 from the support member 50 due to an impact. At the same time, it must be flexible enough to permit the mounting and dismounting of the mat 10 about the support member 50 when desired (see FIGS. 1 and 2). This can be achieved by properly dimensioning the width of the engaging edge 102, 103, and 104 with respect to its length and the rigidity of the cushioning material 20.

While the previous discussion has referred to a substantially vertical slot, the slot may have sides that are sloped as little as forty-five degrees (45°) relative to the ground or floor. Likewise, the engaging edges may also be sloped relative to the ground or floor to provide more secure contact with the variety of support members likely to be encountered in use with gymnastic and athletic equipment.

Any resilient, shock absorbing material, alone or in conjunction with other shock absorbing materials, may be used as the cushioning means. The shock absorbing materials may be combined with rigid materials, as discussed below, to form the cushioning means 20. Alternatively, air, preferably at a pressure greater than one atmosphere may be used as the cushioning means (not shown).

Figure 4:
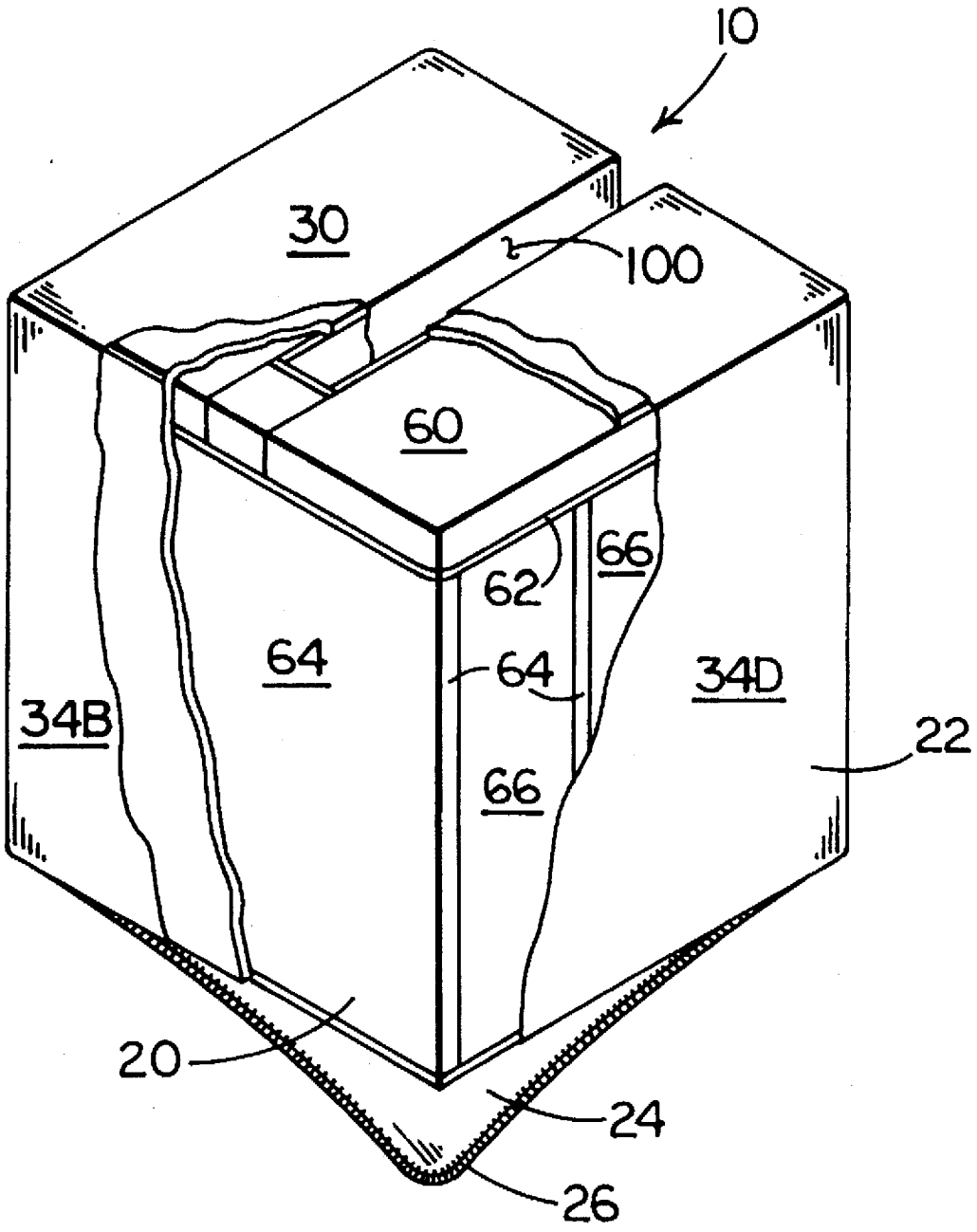
FIG. 4 is a cut-away view of a preferred embodiment of the mat having a U-shaped slot.

With continuing reference to FIG. 4, in the preferred embodiment the cushioning means 20 is composed of several layers of various shock absorbing and rigid materials, disposed in a variety of orientations. Directly beneath and adjacent to top surface 30 of the outer cover 22 is a substantially horizontal layer of cushioning material 60. In the most preferred embodiment the cushioning material 60 is comprised of a cross-linked polyethylene. While at least one layer is necessary, any number of layers may be used, including layers of various types of cushioning materials (not shown).

Disposed beneath the layer of cushioning material 60 is a substantially horizontal rigid layer 62. The rigid layer 62 is preferably composed of ¼ inch thick plywood, although any relatively rigid material would suffice. In addition to providing form to the mat structure, the rigid layer 62 distributes the force of impact over the entire horizontal surface area of the mat 10.

Beneath the rigid layer 62 are a plurality of vertical baffle partitions 64. The baffle partitions 64 are parallel to one another, and preferably parallel to the front wall 34*a* in which the slot 100, 110, 120 is defined. A baffle partition 64 should be adjacent and parallel to front wall 34*a* and rear wall 34*b*. In a preferred embodiment, the baffle partitions 64 are approximately 1 ½ inches thick and spaced approximately 8 inches apart. The baffle partitions 64 are preferably composed of a cross-linked polyethylene foam, although other resilient materials would be suitable. In addition to creating compartmentalized structural spaces within the outer cover 22, the baffle partitions 64 provide structural support to the mat 10. The baffle partitions 64 provide some resiliency against impact.

Filling the compartmentalized spaces defined by the baffle partitions 64 is a baffling material 66. In the preferred embodiment, the baffling material 66 is composed of a polyurethane foam, although other resilient materials or mixtures of resilient material may be used. The baffling material 66 provides the majority of the mat's 10 resiliency or cushioning effect.

The outer cover 22 may be of any dimensions that are suitable for encasing the cushioning means 20.

In FIG. 4, means for allowing the outer cover 22 to be fitted securely over the cushioning means 20 is shown. An aperture 24 in the cover 22 may be fitted with a zipper 26, hook and loop fastener (not shown), snaps (not shown), valve (not shown) or other fastener (not shown), to seal the cover 22 closed once it is fitted on the cushioning means 20. In an alternative preferred embodiment, aperture 24 is not closed with a fastener. Instead, an overlap of material (not shown) is provided, covering the cushioning means 20 which would otherwise be exposed through the gap left by aperture 24. In an additional preferred embodiment (not shown), the outer cover 22 is permanently sewn or otherwise affixed to cushioning means 20, eliminating the need for aperture 24.

Figure 5:
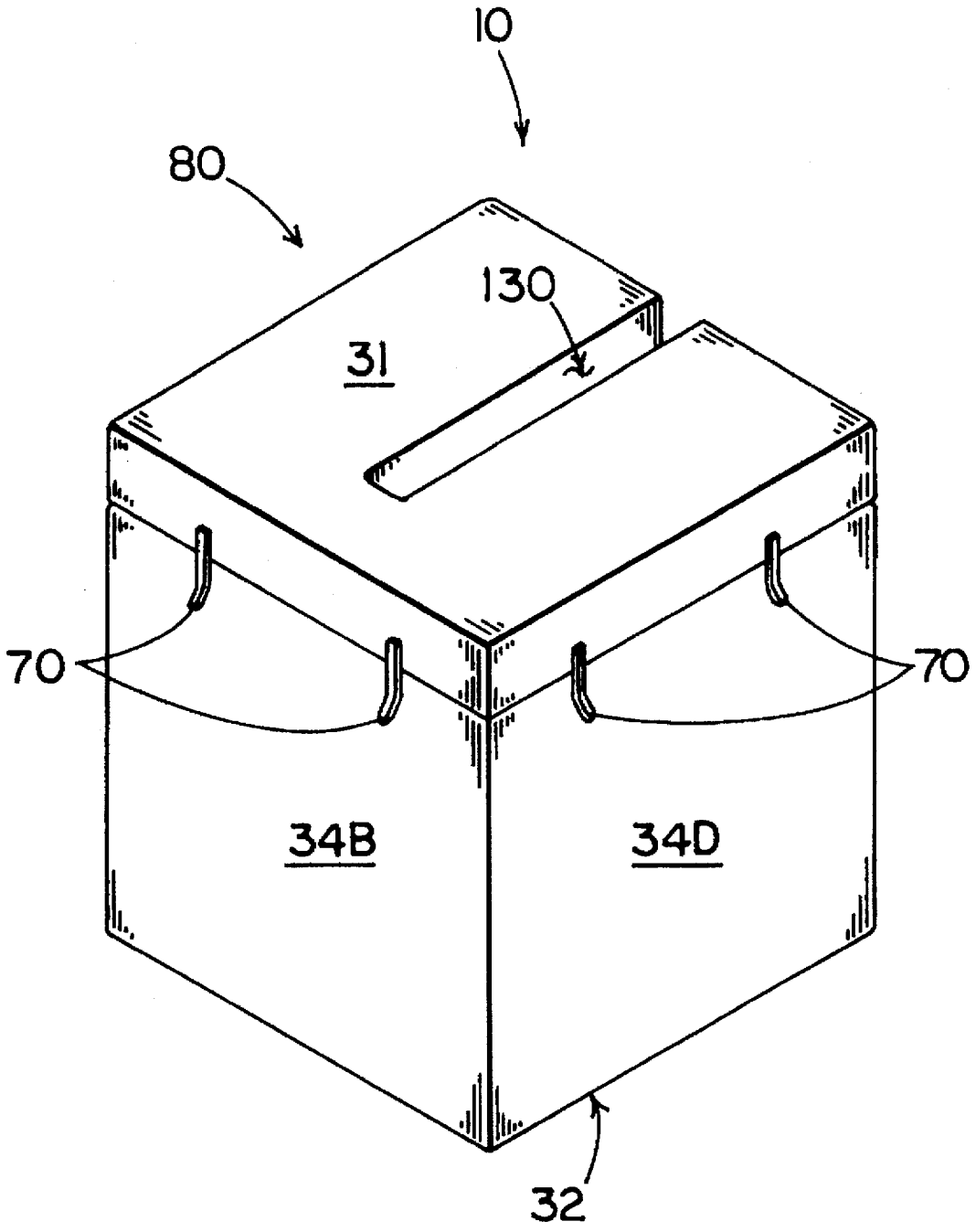
FIG. 5 is a perspective view of a preferred embodiment of the mat having a detachable extension mat mounted thereto, the extension mat having a U-shaped slot.
Figure 6:
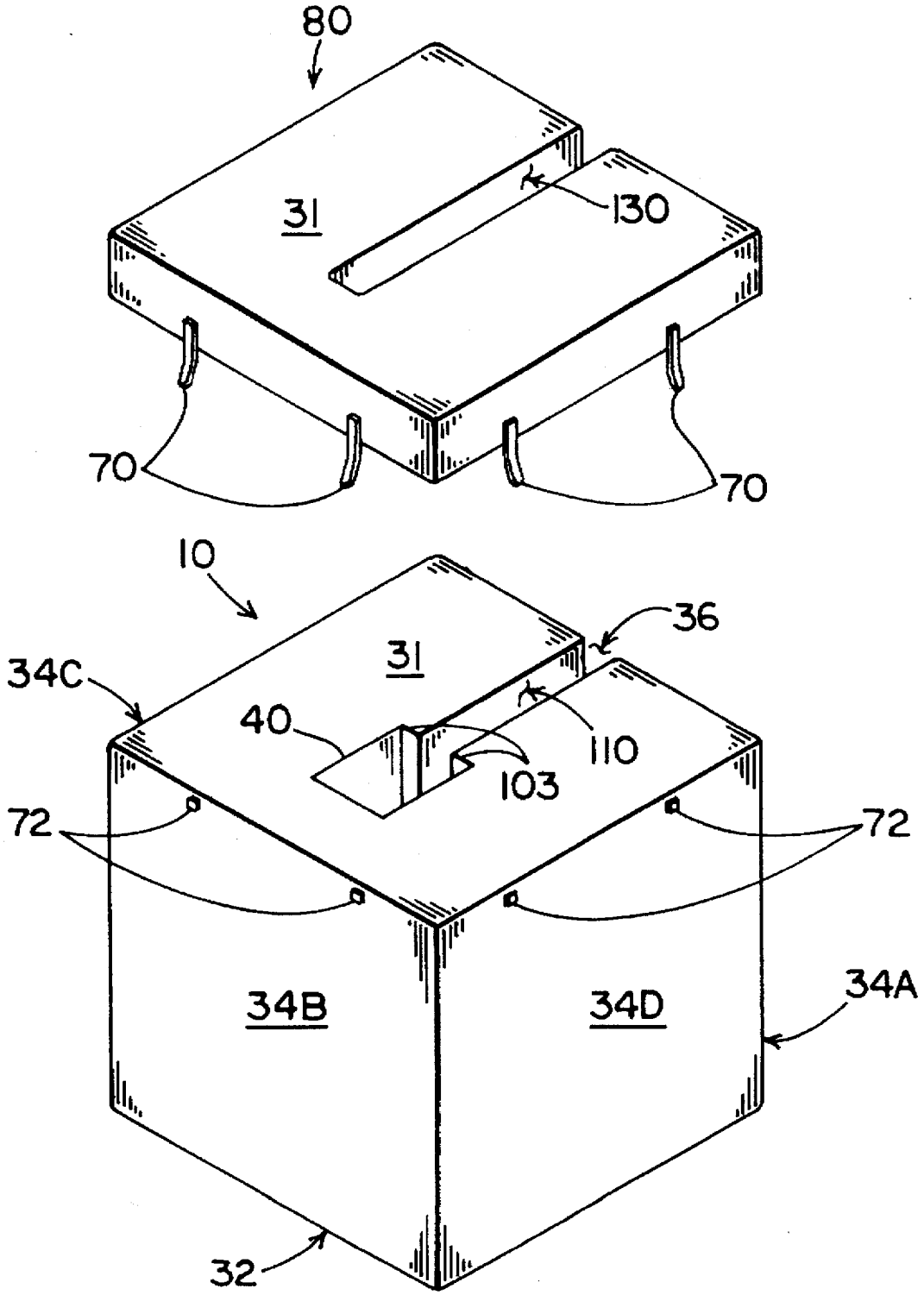
FIG. 6 is a perspective view of a preferred embodiment of the mat having a T-shaped slot, with the detachable extension mat spaced therefrom.

With reference to FIGS. 5 and 6 a second mat 80 may be provided. The second mat 80 has a slot 130 formed therein, the slot 130 being U-shaped in the embodiment shown. A plurality of strips of hook fastener material 70 may be distributed about the periphery of the second mat 80, the strips 70 preferably sewn to the respective outer cover of the mats 80. The second mat 80 can then be removably attached to the mat 10 (hereinafter the first mat) which has loop fastener material strips 72 affixed about its periphery. Thus two or more mats may be removably secured together, to provide varying sizes for use with a variety of athletic equipment, and varying ability levels of the athlete. Any conventional means for securing, such as the hook and loop fastener material may be used.

The slot 130 of the second mat, like the slot 110 of the first mat 10, may be of any shape suitable to the equipment being used.

Figure 7:
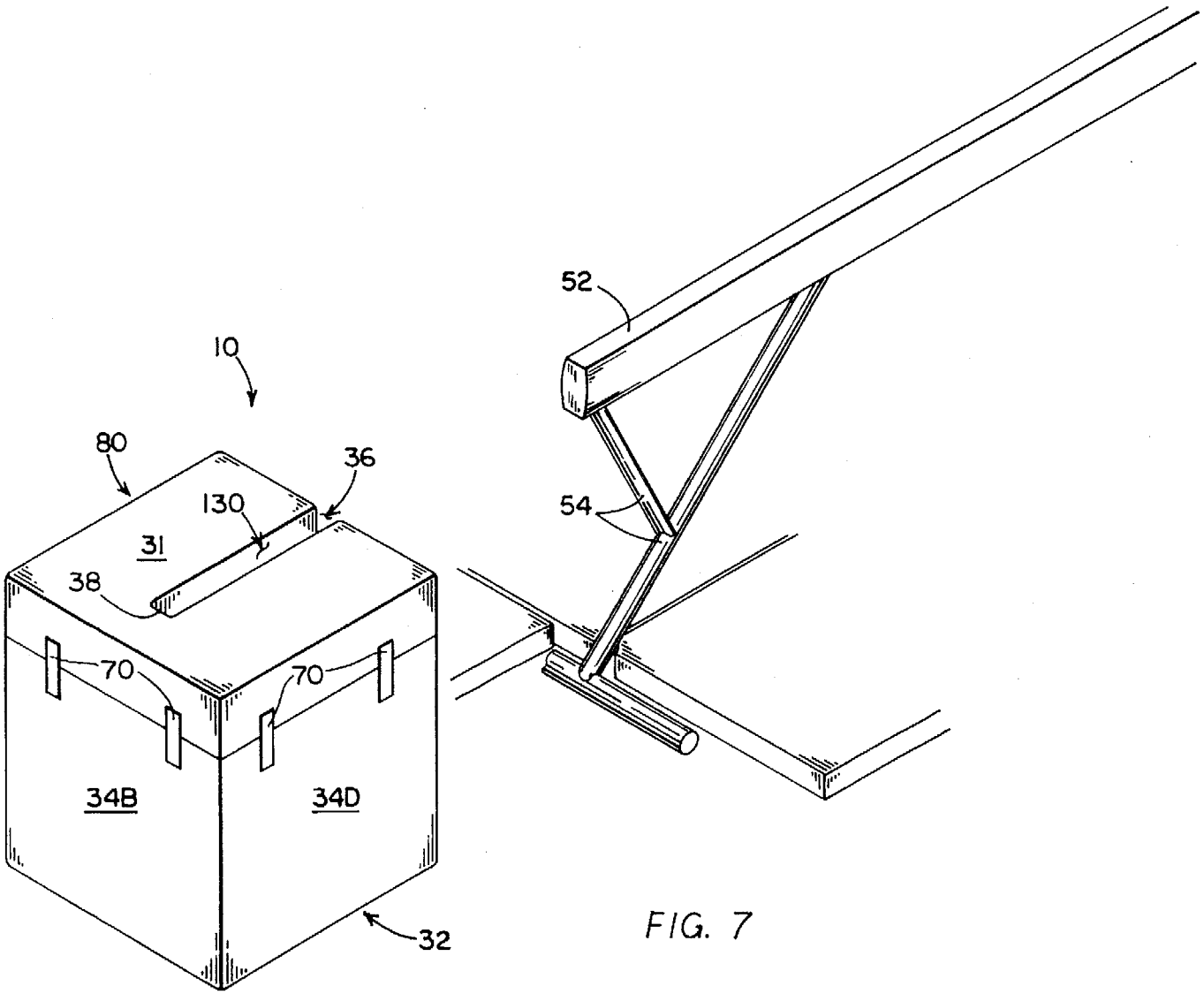
FIG. 7 is a perspective view of a preferred embodiment of the mat having the extension mat mounted thereto positioned to be received on a balance beam.
Figure 8:
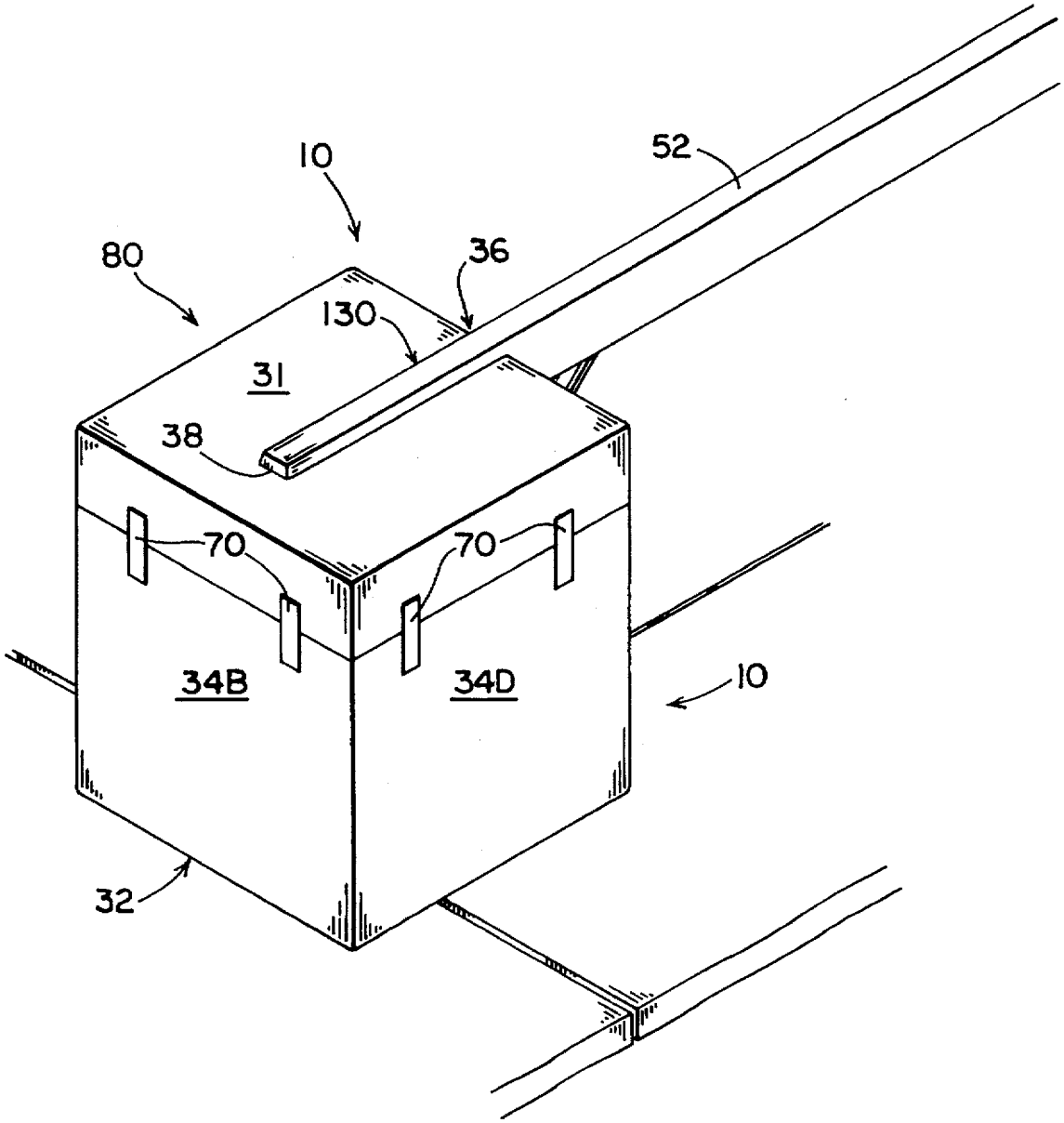
FIG. 8 is a perspective view of a preferred embodiment of the mat, having the extension mat mounted thereto, received on a balance beam.

FIGS. 7 and 8 illustrate the first mat 10 and the second mat 80 in use with a balance beam 52. With reference to FIGS. 5, 6, 7 and 8, in this preferred embodiment the engaging edges 103 are associated with the first mat 10. This provides a secure mounting to the supporting structure 54 of the balance beam 52. The balance beam 52 is of uniform width, and so the U-shaped slot 130 of the second mat 80 is also of uniform width, and dimensioned to receive the end of balance beam 52. The second mat 80 is secured to the first mat 10 using the hook and loop fasteners 70, 72. Second mat 80 provides a close fitting about the balance beam 52 itself, just below its top surface, without leaving any gaps. When used with a balance beam 52, the top surface 31 of the second mat 80 is approximately two inches (2") below the tipper surface of the balance beam 52. In use, if the gymnast misteps, or misses a mount or dismount, she is presented with a rigid, yet cushioned surface on which she may attempt to recover or right herself, and avoid injury.

With further reference to FIGS. 7 and 8, the mats 10, 80 may be mounted about the support member or members 54 of various types of athletic equipment, including gymnastic equipment. In preparation for use of the equipment, the opening 36 in the mat 10 is urged past the support member 54 until the engaging edge or edges 103 of the mat 10 come into operative contact with the support member 54. The second mat 80 may then be secured around the equipment to provide close contact around the equipment. The athletic equipment may then be used in relative safety, the athlete protected from injuries resulting from impact with the supporting structure of the equipment. The second mat 80 may be removed for transportation or storage by first disengaging the hook and fastener attachments and then exerting a force in the horizontal plane, away from the piece of athletic equipment to urge the mat 80 out of contact with the support member 54. Likewise, the first mat 10 may be removed by exerting a force in the horizontal plane, away from the piece of athletic equipment to urge the engaging edges 103 of the mat 10 out of operative contact with the support member 54.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims which follow.

I claim:

1. An article mountable to a non-horizontal support member of a piece of athletic equipment for providing shock absorbing protection about the support member, the article comprising:

an outer cover having a top surface, a bottom surface and at least one wall extending between the top surface and the bottom surface, the wall defining a substantially vertical slot with an opening for receiving the support member of a piece of athletic equipment therein for providing shock adsorbing protection about the support member, and at least one engaging edge extending partially across the opening, the slot extending through the top surface and bottom surface of the outer cover; and means for cushioning received within the outer cover, said means for cushioning including a layer of cushioning material, a relatively rigid layer positioned beneath the layer of cushioning material, and a plurality of baffle partitions positioned beneath the relatively rigid layer.

2. The article for providing shock absorbing protection of claim 1 further comprising:

means for securing at least one gymnastic mat to the article.

3. The article for providing shock absorbing protection of claim 2 wherein the means for cushioning includes air.

4. The article for providing shock absorbing protection of claim 2 wherein the means for cushioning includes a polyurethane foam.

5. The article for providing shock absorbing protection of claim 2 wherein the outer cover is made from vinyl coated nylon.

6. The article for providing shock absorbing protection of claim 1 wherein the slot has a substantially L-shaped horizontal cross-section.

7. The article for providing shock absorbing protection of claim 1 wherein the slot has a substantially T-shaped horizontal cross-section.

8. A gymnastic mat for being received about a non-horizontal support member of a piece of gymnastic equipment, the mat comprising:

an outer covering having a top surface, a bottom surface and at least one wall, the top surface having a periphery, a slot and an engaging edge formed in the slot, the slot defining a portion of the periphery of the top surface, the bottom surface having a periphery, a slot and an engaging edge formed in the slot, the slot of the bottom surface defining a portion of the periphery of the bottom surface, and at least one wall extending between the periphery of the top surface and the periphery of the bottom surface, such that the slots define a substantially vertical opening for receiving the support member of a piece of athletic equipment therethrough for providing shock adsorbing protection about the support member, and an engaging portion of the outer cover defined by the engaging edges extends substantially across the opening for retaining the mat about the support member; and means for cushioning received within the outer covering, to substantially fill the outer covering and to provide shock protection, said means for cushioning including a layer of cushioning material, a relatively rigid layer positioned beneath the layer of cushioning material, and a plurality of baffle partitions positioned beneath the relatively rigid layer.

9. The gymnastic mat of claim 8 wherein the slots are T-shaped.

10. The gymnastic mat of claim 8 wherein the slots are L-shaped.

11. The gymnastic mat of claim 8 further comprising:

means for securing the cushioning article to a second gymnastic mat.

12. The gymnastic mat of claim 8 wherein the means for cushioning includes air.

13. The gymnastic mat of claim 8 wherein the means for cushioning includes a polyurethane foam.

14. The gymnastic mat of claim 8 wherein the cushioning means comprises:

a cross-linked polyethylene foam; and a polyurethane foam.

15. The gymnastic mat of claim 14 wherein the outer cover is made from a vinyl coated nylon fabric.

16. The gymnastic mat of claim 15 wherein the outer cover is at least two feet high, three feet wide and three feet long.

* * * * *